US006241485B1

(12) United States Patent
Warwick

(10) Patent No.: US 6,241,485 B1
(45) Date of Patent: Jun. 5, 2001

(54) WASTEWATER FLOW CONTROL SYSTEM

(76) Inventor: John W. Warwick, 309 Sunfish La., Virginia Beach, VA (US) 23456

( * ) Notice: Subject to any disclaimer, the term of this patent is extended or adjusted under 35 U.S.C. 154(b) by 0 days.

(21) Appl. No.: 09/473,672

(22) Filed: Dec. 29, 1999

(51) Int. Cl.[7] ..... F04B 49/00
(52) U.S. Cl. ..... 417/300
(58) Field of Search ..... 417/300, 40

(56) References Cited

U.S. PATENT DOCUMENTS 3,563,382 * 2/1971 Regent ..... 210/104
3,673,164 * 6/1972 Jones et al. ..... 526/291
4,529,359 * 7/1985 Sloan ..... 417/34
4,867,646 * 9/1989 Coudriet ..... 417/40
5,575,304 * 11/1996 Hassett ..... 137/1

* cited by examiner

*Primary Examiner*—Teresa Walberg
*Assistant Examiner*—Vinod D. Patel
(74) *Attorney, Agent, or Firm*—David J. Bolduc

(57) ABSTRACT

A sewage pumping apparatus is provided for delivering sewage collected by gravity in a wet well to a force main. The sewage pumping apparatus comprises a motor controlled pump in fluid communication with the wet well for supplying sewage to the force main via a pinch valve. A fluid parameter sensing device is provided at the outlet of the pump for producing an electrical signal output proportional to the sensed fluid parameter (pressure or flow rate). A Digital Process Controller (DPC) receives and compares the electrical signal from the fluid parameter sensing device to a system setpoint and produces a signal outputs to open or throttle the pinch valve in accordance with the desired system backpressure to prevent overloading or cavitation of the pump and to clear blockages in the system.

11 Claims, 2 Drawing Sheets

WASTEWATER FLOW CONTROL SYSTEM

BACKGROUND OF THE INVENTION

1. Field of the Invention

This invention relates generally to sewage wastewater transport systems. More specifically, the present invention relates to a feedback control system downstream from a pump for delivering sewage from a wet well to a force main. In the present invention, the pump and a valving system respond to the pressure or flow sensed downstream of the pump to ensure the proper operation of the pump while delivering wastewater into the force main.

2. Description of the Prior Art

Wastewater and sewage are transported to a treatment plant via a collection system. The terms "sewage" and "wastewater" as used herein are defined as the liquid waste containing both dissolved and suspended solids resulting from the discharge of toilets, baths, sinks and other fixtures in residential building or commercial establishments. Sewage also includes other suspended solid items that enter the waste collection stream, for example through open sewer drains, including trash, wood, dead animals and the like.

Sanitary sewage systems have customarily been designed to provide a gravity flow of the sewage from the point of entering the system to its final discharge. These systems consist of gravity sewer lines, pump stations and force main lines. In these systems sewage is collected in sumps or wet wells at pump stations at one or more low points in the system, from which the sewage must be pumped through force mains toward the treatment plant. Such systems are normally designed to provide velocities of at least 2 feet per second to ensure the prompt arrival of the sewage at the treatment plant or disposal site and to prevent settlement of solids in the force main.

The gravity system includes miles of pipes that generally range in size from 6 to 48 inches in diameter. Gravity sewers are constructed of relatively large diameter pipes so as to accommodate peak flows and so as to avoid being obstructed by the passage of solids contained in the sewage which are frequently stranded in the pipe system during periods of low flow, and are subsequently recaptured during later periods of high flow.

These lines feed into the main pump stations that typically are capable of pumping thousands of gallons per minute. Lift stations or pump stations are required because a point is reached where it becomes impractical to lay gravity-flow sewer lines any deeper underground. In practice, such known sewage systems typically comprise a plurality of pits for supplying each wet well and a plurality of wet wells for supplying each treatment plant via several pump stations. The pump stations discharge into force main lines. Pump and lift stations may be further provided to supplement the pressure in the force main. These force main pipes eventually lead to a treatment plant.

In prior art sewage transport systems the pumping means for delivering sewage from the wet well to the force main has taken various forms. For example, electrically or hydraulically driven submersible pumps may be located in a wet well. Typically, the type of pump used most often to deliver sewage from the wet well to the force main is a centrifugal pump specifically designed for pumping sewage and solids.

There are several kinds of centrifugal pumps including radial-flow, mixed-flow, and axial flow. In a centrifugal pump, an impeller forces the liquid being pumped into a rotary motion, and a volute (casing) directs the liquid toward the impeller. As the impeller rotates, the liquid leaves the impeller with a higher velocity and pressure than it had when it entered because the impeller produces liquid velocity and the volute forces the liquid to discharge from the pump. This velocity and pressure increase is accomplished by offsetting the impeller in the volute and by maintaining a close clearance between the impeller and the volute (at the cutwater). In this fashion, a centrifugal pump impeller slings the liquid out of the volute. The size of the impeller and the pump casing vary greatly with the type of centrifugal pump.

Every pump can add different amounts of head or pressure to the liquid it is pumping depending on the flowrate. A positive suction head exists when the liquid is taken from an open atmosphere tank where the liquid level is above the centerline of the pump suction, commonly known as a flooded suction. A suction lift exists when the liquid is taken from an open atmosphere tank where the liquid level is below the centerline of the pump suction. Pump Performance Curves are produced by a pump manufacturers to show the relationship between flow and total dynamic head, the efficiency, the Net Positive Suction Head Required (NPSHR), and the Brake Horse Power Required (BHPR). A pump curve, as in FIG. 1, is the characteristic curve showing the ability of the pump to add head at different flow rates. As shown by the performance curve, a higher head corresponds to lower flow and a lower head corresponds to higher flow. Furthermore, a lower flow corresponds to lower horsepower requirement and a higher flow corresponds to higher horsepower requirement. A system curve represents the head losses due to losses and friction as well as the static lift in the pumping situation of interest and may be overlaid on the pump curve. The point where the curves cross is the operating point of the pump in the particular system.

Because a centrifugal pump is a variable displacement pump, the actual flow rate achieved is directly dependent on the total dynamic head against which the pump must work. The flow capacity of a centrifugal pump also depends on the pump design, the impeller diameter and the pump speed and the net positive suction head. The Net Positive Suction Head Required (NPSHR) is a function of the pump design at the operating point on the pump performance curve. The Net Positive Suction Head Available (NPSHA) is a function of the pump suction piping system and the amount of lift the pump is performing. However, if the NPSHA is less than the NPSHR, the pump will cavitate.

Cavitation is a major problem that may occur in wastewater pumping systems. Cavitation may occur in two different forms: suction cavitation and discharge cavitation. Suction cavitation occurs when the pump suction is under a low pressure/high vacuum condition where the liquid turns into a vapor at the eye of the pump impeller. This vapor is carried over to the discharge side of the pump where it no longer sees vacuum and is compressed back into a liquid by the discharge pressure. This imploding action occurs violently and attacks the face of the impeller. An impeller that has been operating under a suction cavitation condition has large chunks of material removed from its face causing premature failure of the pump.

Discharge cavitation occurs when the pump discharge is extremely high. It normally occurs in a pump that is running at less than 10% of its best efficiency point. The high discharge pressure causes the majority of the fluid to circulate inside the pump, instead of being allowed to flow out the discharge. As the liquid flows around the impeller it must pass through the small clearance between the impeller and the pump cutwater at extremely high velocity. This velocity causes a vacuum to develop at the cutwater and turns the liquid into a vapor. A pump that has been operating under these conditions shows premature wear of the impeller vane tips and the pump cutwater. In addition, due to the high-pressure condition, premature failure of the pump mechanical seal and bearings may occur and under extreme conditions will break the impeller shaft.

Another problem peculiar to wastewater collection systems is blockage of the system and components by the solids within the sewage. Based on the determination that impellers suited for the conveyance of solid additions tend to be blocked under unfavorable circumstances, the prior art has contemplated solutions to the problem. U.S. Pat. No. 5,348,444 to Metzinger discloses a single-blade impeller for centrifugal pumps which fulfills the basic prerequisite of freedom from blockages, and has a calibrated design which attempts to reduce the cavitation present in the intake zone of the single-blade impeller.

Another problem peculiar to wastewater collection systems is the unpredictable flow rate of wastes through the system. Currently used collection and treatment processes of necessity must operate with flow rates that vary from as much as 250% increase over average daily flow during peak periods to as low as 10% of average daily flow during night and early morning periods. It is therefore required that a pump station centrifugal pump be rated to handle peak flow capacity to pump wastewater from the wet well to the force main under peak flow conditions. The same pump however, must also be able to effectively pump wastewater to the force main under low flow conditions.

Thus, the conveying conditions of such a centrifugal pump normally undergo continuous change. The positive pressure head varies between a maximum and a minimum value and the working point of the centrifugal pump, the intersection of the constant pump characteristic line and the variable system characteristic line, accordingly is likewise subjected to the change. In most applications, it is preferred that centrifugal pumps are operated at constant rpm. However, in order to address the need to overcome changing flow conditions, the prior art has contemplated using multiple pumps or a variable speed pump. Both of these options increase the cost for components and maintenance and operation of a pump station.

Another problem peculiar to wastewater collection systems is the backpressure encountered from force mains. It is a requirement in waste collection systems, that under peak flow or low flow conditions, the pump must discharge the wastes at a sufficient pressure to overcome the pressure of the force main, typically 0–100 psig.

Premature failure of the centrifugal pump due to damage from blockage or cavitation is undesirable. Failure of the pump to operate, or failure to fulfill flow requirements can cause sewage back-up and overflow from the wet well with obvious undesirable consequences to the environment in the vicinity of the pump station.

One prior art solution to overcome pump failure is to provide a standby engine-driven generator at the pump station to provide emergency electric power in case of a power outage on the utility lines. However, since the electric motors to be powered by the engine-driven generator typically can require for startup up to 400 percent of the power needed for normal running, the engine-driven generator must be an oversized expensive machine which can cost a considerable amount of money.

Such equipment is infrequently used and, even then, seldom at full capacity. Another prior art solution is described in U.S. Pat. No. 4,529,359 to Sloan, which provides sewage pumping means for a lift station that provides standby hydraulic pumps to supplement existing electrical or hydraulic submersible pumps. This equipment can also be quite expensive.

These solutions also do not address the basic problems of clearance of blockages and cavitation that most often cause the premature failure of the pump.

SUMMARY OF THE INVENTION

A sewage pumping and control system in accordance with the present invention is provided for delivering sewage from a wet well at a pump station to a force main or the like in a sewage collection system. The apparatus comprises a pump including a drive motor for disposition downstream of the wet well and operative for supplying sewage to the force main. The apparatus further comprises a pinch valve downstream of the pump for throttling the flow of the sewage from the pump to the force main. Throttling of the pinch valve is controlled by a motor controller having inputs from a Digital Process Controller (DPC), which senses the flow or pressure of a waste stream at the pump outlet. The control system is also self cleaning, due to the fact that when blockage occurs, the DPC in conjunction with the pressure sensing device will cause the pinch valve to open fully, thereby clearing any obstruction.

It is therefore an object of this invention to provide as part of the sewage collection system, a pump station and control system therefore, which does not require a high degree of technology for its proper operation while permitting a minimum amount of attendance for its operation and maintenance.

It is another object of the present invention to provide as part of the sewage collection system, a pump station that eliminates the requirement for variable speed pump drives to handle varying backpressure conditions in a force main.

It is another object of the present invention to provide as part of the sewage collection system, a control system in a pump station responsive to both peak flow and low flow backpressure conditions without adversely affecting the pump or motor.

It is another object of the present invention to provide as part of the sewage collection system, a control system in a pump station that efficiently delivers sewage to a force main against variable backpressure in a force main.

It is another object of the present invention to provide as part of the sewage collection system, a control system in a pump station that delivers sewage to a force main without creating cavitation at the pump or downstream of the pump.

It is another object of the present invention to provide as part of the sewage collection system, a control system in a pump station that delivers sewage to a force main without overloading the pump motor causing it to overheat and cut off.

It is another object of the present invention to provide as part of the sewage collection system, a control system in a pump station that delivers sewage to a force main while minimizing blockage of system components.

It is another object of the present invention to provide as part of the sewage collection system, a pump station with self-cleaning components.

It is another object of the present invention to provide as part of the sewage collection system, a control system in a pump station that delivers sewage to a force main that is resistant to the caustic or corrosive environment of a wastewater collection system.

It is another object of the present invention to provide as part of the sewage collection system, a control system for a pump station that is easily retrofitted to existing systems.

It is another object of the present invention to provide as part of the sewage collection system, a control system in a pump station that may allow for users to easily modify system operating parameters in accordance with changing system conditions.

DRAWINGS

DESCRIPTION OF PREFERRED EMBODIMENT

The present invention uses several different pieces of equipment in combination to control the pressure and or flow of a wastewater pump to prevent it from either overloading the motor or causing cavitation inside the pump, or from subjecting the pump to conditions outside its design parameters. Because of the problems unique to the treatment of raw sewage, including: clogging of control devices, and reliable pumping of raw sewage using any control means whatsoever, this type of control system has not heretofor been suggested in the art. The invention employs in combination several devices including a pinch valve, which has a flexible membrane designed to control the flow of a medium, including a waste stream containing solids such as raw sewage. The invention also uses a Digital Process Controller (DPC) in combination with a pressure or flow sensing device and the automated pinch valve. The control system is also self cleaning, due to the fact that when plugging occurs, the DPC in conjunction with the pressure sensing device will cause the pinch valve to open fully, thereby clearing any obstruction.

Figure 2:
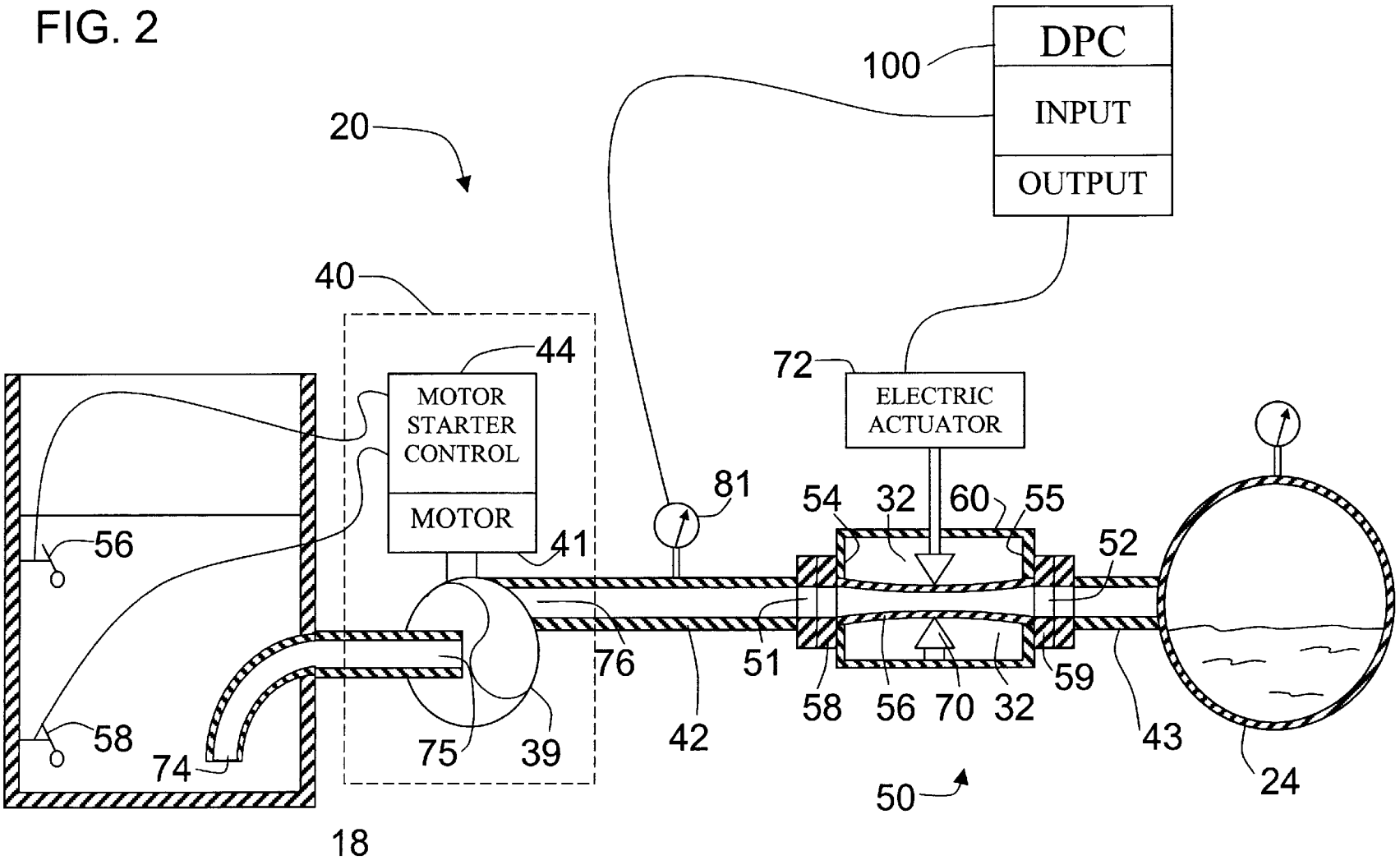
FIG. 2 is a partial schematic elevation of a sewage pump station system employing sewage pumping means and a control system in accordance with the present invention.

Referring to FIG. 2, there is shown in partially schematic form (and not to scale) a sewage pump station system in accordance with the invention which is generally arranged as follows. Sewage from a plurality of primary sources such as homes or dwellings (not shown) is supplied by gravity through a plurality of sloped mains or conduits (not shown) to a wet well 18 which is part of a pump station 20. Pump station 20 further includes sewage pumping means 40, preferably a centrifugal pump, which supplies sewage from wet well 18 to a sloped force main 24 and from thence to a collection tank at a sewage treatment plant (not shown). Additional pumps stations are typically provided for the force main 24.

As FIG. 2 shows, pump station 20 forming part of the sewage disposal system includes wet well 18 and sewage pumping means or apparatus 40 for delivering sewage collected by gravity in wet well 18 through a pinch valve 50 to force main 43 and 24 which supplies sewage under pressure to a remotely located sewage treatment plant or another pump station. The sewage pumping apparatus generally comprises a pump unit 40 located downstream of the wet well 18 for supplying sewage from a first sewage conduit 42 to a second sewage conduit 43 (which is a force main) to a larger force main 24. The pump unit 40 comprises an electric motor 41 for driving a centrifugal pump 39, preferably at a constant rpm, and a motor controller 44 for energizing and de-energizing the electric motor 41. The pumping unit 40 may alternatively comprise a variable speed motor and a speed controller for the variable speed motor.

The pump station 20 may further include means, including float switches 56 and 58, for sensing the sewage level in the wet well 18 and for regulating the on/off operation of the pump motor 41 so as to adjust the output of the pump 39 and maintain the sewage at a safe level in the wet well 18. The pump station 20 may also comprise means, including an emergency float switch, responsive to wet well 18 near-overflow (and optionally a speed control circuit responsive thereto) for regulating the operation of the pump unit 40 (or a standby pump) and thereby to control the output accordingly.

The pump unit 40 comprises a centrifugal pump 39 driven by a motor 41. The motor 41 is preferably electrically driven, but may also be driven by a diesel or gasoline engine or hydraulic means. Centrifugal pump 39 comprises liquid inlet and outlet ports 75 and 76, respectively. Inlet port 75 is connected to the wet well 18 via inlet pipe 74 extending nearly to the bottom of the wet well 18 and is in fluid communication with the liquid sewage in the wet well 18. The motor 41 of pump unit 40 is energizable for operation via motor starter and controller 44 connected to a source of AC electrical power. Motor starter and controller 44 is commercially available and conventional in construction and mode of operation and is understood to contain components (not shown), such as switches, relays, contactors, circuit breaker and so forth, necessary to enable starting, stopping and normal operation of motor 41. It is to be understood that controller 44 contains a relay which operates to turn the motor 41 on and off in response to signal information pertaining to the level of sewage in wet well 18 received through a conductor wire or cable connected to the float switches 56 and 58 which are located in wet well 18. Lowermost float switch 58 is located so that it operates to stop the pump motor 41 whenever the sewage level in wet well 18 descends to a level just above submersible inlet pipe 74, so that the pump's intake port 75 always has a flooded suction. Upper float switch 56 is located above the lower float switch 58 so that it operates to start the motor 41 whenever the sewage level in wet well 18 rises to a level relatively near the upper end of the wet well 18. An emergency float switch may be provided at a near overflow level of the wet well 18 to effect automatic start-up of a standby pump (not shown) so as to place it in service if the main pump unit 40 fails or is unable to keep up with the flow of wastewater into the wet well 18.

The outlet port 76 of the pump 39 is connected to one end of a sewage conduit 42 whose opposite end is connected to the inlet 51 of a pinch valve assembly 50. The outlet 52 of the pinch valve assembly 50 is connected to one end of a sewage force main 43, which has its opposite end connected to a second larger force main 24. The sewage conduit 42 and force main 43 may take the form of a non-collapsible, flexible hose or may be a pipe of a solid construction such as cement or metal, for example.

The pinch valve assembly 50 receives sewage pumped through the sewage conduit 42 at the valve inlet 51 and passes an amount of the sewage through the valve outlet 52 into the sewage force main 43, depending upon the amount of pressure applied to a deformable sleeve 56 within the pinch valve assembly 50.

The pinch valve assembly 50 is commercially available and includes a generally cylindrical outer housing 60 having first and second housing flanges 54 and 55. Positioned within housing 60 is a generally hollow cylindrical flexible distortable rubber-like valve member 56 having first and second sleeve flanges 58 and 59. The sleeve 56 is preferably constructed much like a heavy-duty truck tire, with bias-ply, fabric-reinforced rubber providing the structural support of the sleeve 56. The sleeve 60 is secured within the housing 60 at their respective first flanges 54 and 58 and second flanges 55 and 59.

Housing 60 includes a passage in communication with an annular space 32 formed between the interior surface of housing 60 and the outer surface of sleeve 56. In the preferred embodiment of the invention, mechanical pressure may be applied to the sleeve 56 within the annular passage 32 to make the sleeve 60 collapse inwardly upon itself. This mechanical pressure may be in the form of a mechanical valve mechanism 70 inside the housing 60, as shown in FIG. 2. Alternatively, air pressure or fluid pressure of some type, may be applied through the passage into annular space 32 to cause sleeve 56 to collapse upon itself. The end result of the application of mechanical pressure to the sleeve 56 is that the normal generally cylindrical passage between the inlet and outlet 51 and 52 of the sleeve 56 is closed (at least partially) thus shutting off (or throttling down) flow through the sleeve 56. Thus, application of mechanical pressure to the exterior of the sleeve 56 will throttle the flow by causing the sleeve's 56 interior longitudinal cross-sectional area to decrease.

Pinch valve assemblies 50 are preferable to conventional metal valve designs because of the abrasion resistance of the elastomer sleeve 56, which provides the valve lining, flange gaskets, and a seating surface all in one. Since the sleeve 56 is the only wetted part of the valve 50, there is no need for expensive metal alloys to be used in the body 60 of the valve 50. This design also eliminates fugitive emissions, and the packing and seats that are responsible for most valve maintenance.

The design of the sleeve 56 is ideal for slurry and solids handling applications where an unobstructed flow path is essential, as in the present wastewater application. Furthermore, in throttling applications, the sleeve 56 maintains a laminar flow for better control, and eliminates turbulence and wear with less cavitation. Thus, when mechanical pressure is fully released from the sleeve 56 (100% full-port) it is like a pipe in-line and when throttling, the flow remains streamlined. The pinch valve sleeve 56 is selected specially for the flow range and pressure of the system within which it is included. These parameters include output pressure of the pump 39, diameters of the inlet sewage conduit 42 and outlet sewage force main 43, and the flow and type of wastewater within the conduit 42 and force main 43. The pinch valve assembly 50 should also be selected to preclude cavitation in the outlet 52 and downstream portion of the valve 50 itself.

The pinch valve assembly further comprises means for application of pressure to the pinch valve sleeve 56. The application of pressure to the pinch valve sleeve 56 is controlled by a mechanical operating mechanism 70 coupled to a valve actuator 72. The mechanical pressure is preferably applied and released using a mechanical operating mechanism 70 controlled by an electrical valve actuator 70. Pinch valve assembly 50 manufacturers however provide many other valve actuation designs including manual, manual geared, pneumatic, and hydraulic actuators. The valve actuator 72 of necessity should be a device of high quality and accuracy in order to function properly and avoid "hunting," which occurs when a valve oscillates about a position rather than quickly and accurately actuating to the correct valve position. The electromechanical valve actuator 72 is able to receive an electrical control input preferably in the range of 4–20 milliamps. The control input preferably is received from a Digital Process Controller (DPC) 100. It is within the scope of the invention however for the valve actuator 72 to receive electrical control input in the range of millivolts to volts or even pneumatic or hydraulic control inputs.

The pump station 20 further comprises a fluid parameter sensing device 81. The fluid parameter sensing device 81 for the pump station control system may comprise a pressure sensing device or a flow sensing device or combinations thereof. Pressure type sensors include DP cells, or pressure gauges or other pressure sensing devices, preferably with an electrical signal output proportional to the sensed pressure. Devices which sense the flow of a medium (and may enable control of the flow of the medium) include magnetic meters, flow tubes, water meters, turbine or disk type flow meters, doppler meters or other flow sensing devices, preferably with an electrical signal output proportional to the sensed flow rate.

The fluid parameter sensing device 81 is in communication with the sewage conduit 42 at the outlet 75 of the pump 39. The fluid parameter sensing device 81 is in communication with the sewage conduit 42 to allow the device 81 to sense the flow or pressure of the wastewater as it exits the pump 39. The sensing device 81 preferably has an electrical output signal that is proportional to the range of its design fluid parameter, such as the pressure or flow of the installation (sewage collection system). A typical and preferred electrical output signal from the fluid parameter sensing device 81 is a 4–20 milliamp output signal, either from a pressure sensor or flow meter which is used to sense a fluid parameter (pressure or flow) desired to be controlled.

The central control mechanism in the pump station 20 is a Digital Process Controller (DPC) 100 which can receive (4–20 milliamp) electrical input signal(s) from the fluid parameter sensing device 81 and can generate an electrical output signal for controlling other devices, such as the electrical actuator 72 for the pinch valve assembly 50 or even the motor controller 41 for the pump unit 40. Input and output control signals need not be in the milliamp range, but may also be in the millivolt to volt range.

The DPC 100 is equipped with several setpoint adjustment means including, for example gain control, sensitivity controls and delay controls, customizable for each sewage pumping installation. The gain setpoint for the DPC 100 corresponds to the amount of gain in the output signal in response to an input signal (or a difference between an input signal and a setpoint). The gain thereby determines the magnitude of a DPC output signal and thereby the position of the valve actuator 72 and pinch valve assembly 50. The delay or deadband setpoint corresponds to the minimum input signal difference that will cause an output signal to be generated by the DPC 100. For example, the deadband setpoint may require a change of 0.05 milliamps in an input signal (corresponding for example to a 1 psi pressure change) in order to generate an output signal that will ultimately change the position of the valve actuator 72 and pinch valve assembly 50. The deadband setpoint prevents the system from constantly hunting or unnecessarily cycling the valve position. The sensitivity setpoint controls the rate of rise or fall of an output signal and therefore corresponds to how quickly the valve actuator 72 will open or throttle the pinch valve assembly 50. The employment of these control means by DPC 100 also makes the system suitable for simple retrofitting of existing systems, as well as for new system installations.

OPERATION: When the level of wastewater in the wet well reaches the upper float switch 56, a signal is sent to the motor controller 44 which starts the pump motor 41. When the pump motor 41 starts, the centrifugal pump 39 impeller rotates which takes a suction from the inlet 74 from the wet well into the pump inlet 75 and out of the pump outlet 76 at an output pressure and velocity. The pump unit 40 continues pumping until the wastewater level in the wet well 18 reaches the level of the lower float switch 58. When the level of wastewater in the wet well 18 reaches the lower float switch 58, the float switch 58 sends a signal to the motor controller 44 which stops the pump motor 41 and thereby the pump 39. Stopping the pump 40 at this point maintains a flooded suction 75, and prevents the inlet 75 of the centrifugal pump 39 from taking in air so that the pump 40 does not have to be primed or from causing a suction cavitation.

The current practice in wastewater collection and transmission systems is to use a pump able to operate with constant flow rates that vary in the duration of their operation and to handle a 250% increase over average daily flow during peak periods to as low as 10% of average daily flow during night and early morning periods. Under peak flow conditions, the output pressure of wastewater pumps is typically required to be 30 to 90 psi. These peak flow conditions in a receiving force main however only occur in a very small percentage of the time of overall operation time of the pump. The typical backpressure in a receiving force main is generally 20 percent of the maximum required during peak flow conditions.

Figure 1:
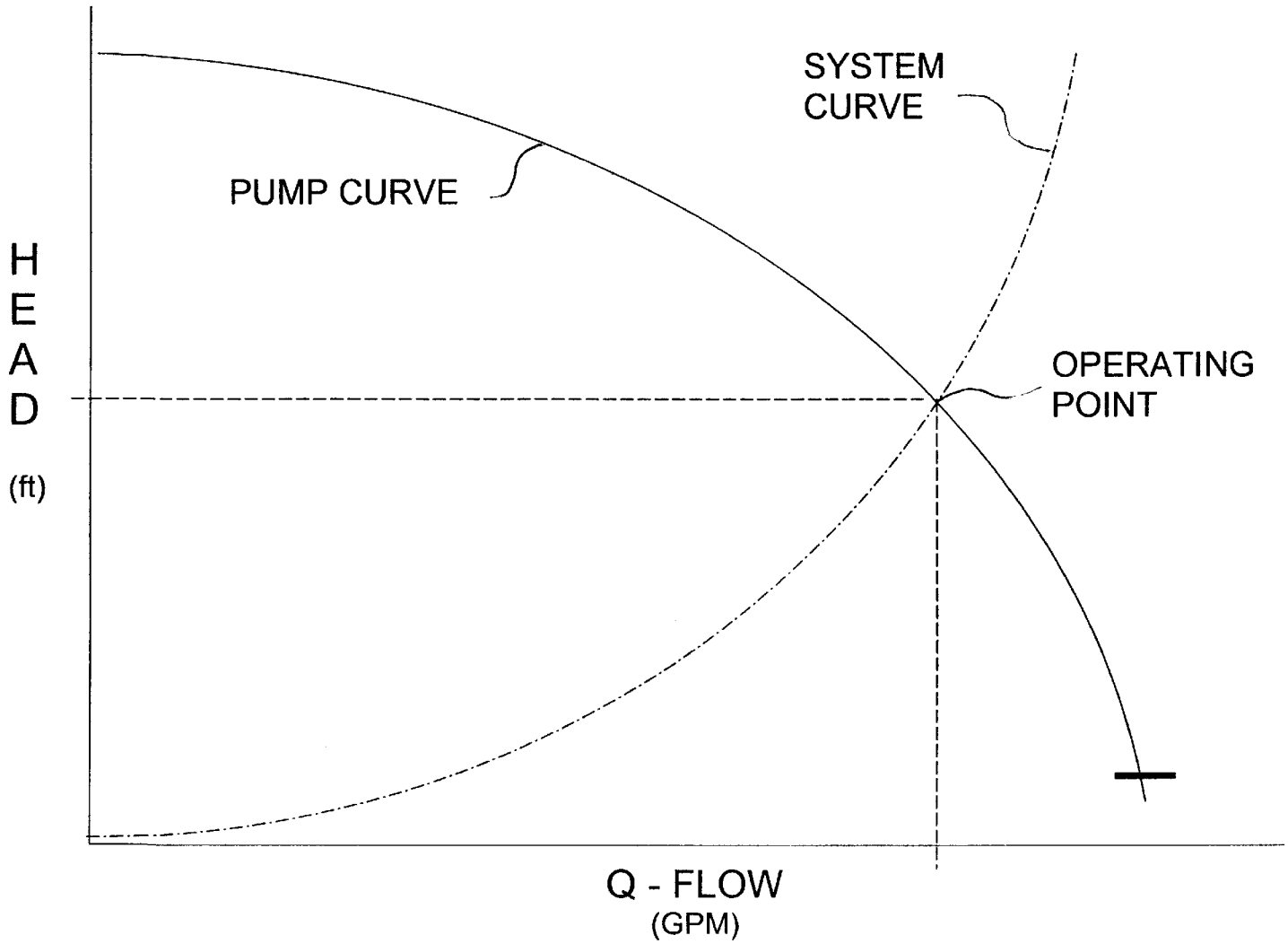
FIG. 1 is a pump performance curve overlaid with a system operating curve.

Since pumps are required to have an operating point suitable for worst case flow conditions. When the pump is operating with a backpressure less than these conditions, it is not operating efficiently and is subject to cavitation. These pumps, while pumping off the optimal operating point under low flow conditions, are therefore more likely to cause premature failure of the pump. This is because under low backpressure conditions, the pump requires greater horsepower, as illustrated by the pump curve in FIG. 1. In addition, if the pump backpressure is low, in order to function properly the pump develops a higher flow output. Because the flow is high and the head is low, the pump will tend to cavitate.

In the present invention, the fluid parameter sensing device 81 senses the flow or pressure of the wastewater in the sewage conduit 42 at the outlet of the pump 39. The fluid parameter sensing device 81 then generates an electrical signal, preferably in the range of 4–20 milliamps, which is proportional to the sensed fluid parameter. This signal is an input signal to the DPC 100.

By using a programmable DPC 100, a method can now be implemented to control the flow and/or backpressure of wastewater through the pump 40, thereby preventing cavitation or overloading of the pump motor 41. The DPC 100 compares the input signal to a setpoint on the DPC 100. The input signal is between 4 and 20 milliamps and corresponds, for example, to the pressure at the outlet 76 of the pump 39. The setpoint on the DPC 100 is between 4 and 20 milliamps and is proportional to the pressure desired for the pump backpressure (between 0 and 100 psi). If the input signal is greater than the setpoint, this corresponds to the pressure downstream of the pump 39 being greater than the minimum desired backpressure to be sustained at the pump outlet 76. If the input signal is less than the setpoint, this corresponds to the pressure downstream of the pump 39 being less than the minimum desired backpressure to be sustained at the pump outlet 76. If the first input signal is equal the setpoint, this corresponds to the pressure downstream of the pump 40 being equal to the minimum desired backpressure to be sustained at the pump outlet 76.

The DPC 100 is programmed to control the valve actuator 72 for the pinch valve assembly 50 on the basis of the input signal received from the fluid parameter sensing device 81. When the pressure input signal is greater than the setpoint, the DPC 100 sends an output signal to the valve actuator 72 which removes mechanical pressure from the sleeve 56, thereby opening the pinch valve 50 until the pressure input signal matches the pressure setpoint. This allows the wastewater to have a higher flow from the pump 39 through the sewage conduit 42 to the force main 43 and 24 with the desired setpoint backpressure. Too much backpressure and not enough flow will also cause discharge cavitation, which may prematurely age the pump.

When the pressure input signal is less than the pressure setpoint, the DPC 100 sends a signal to the valve actuator 72 which increases mechanical pressure to the sleeve 56, thereby throttling the pinch valve sleeve 56. The pinch valve assembly 50 is throttled in an amount sufficient to match the backpressure setpoint of the DPC 100. The pinch valve 50 is throttled at a rate corresponding to the difference between the input signal and the setpoint according to the sensitivity setpoint of the DPC 100. As the pinch valve assembly 50 is throttled, it creates backpressure upstream of the pinch valve outlet 52 thereby reducing the flow downstream of the pump 39. As this backpressure increases, the pressure sensed at the fluid parameter sensing device 81 increases. The throttling of the pinch valve 50 continues until the pressure sensed at the fluid parameter sensing device 81 is equal to the DPC pressure setpoint or at least not in excess of the difference between the pressure setpoint and the deadband setpoint of the DPC 100. This allows the wastewater to have the desired flow from the pump 39 through the sewage conduit 42 and force mains 43 and 24 with the preset backpressure. This backpressure is preset on the DPC 100 to provide for the most efficient operating conditions for the pump 39, and is sufficient to ensure that there is proper flow through the pump 39, and that the pressure will not cause discharge cavitation, which may prematurely age the pump.

Alternatively, the input signal corresponds, for example, to the flow rate at the outlet 76 of the pump 39 and is between 4 and 20 milliamps. The flow rate input signal is compared to a flow rate setpoint of the DPC, which is selected to be between 4 and 20 milliamps and is preset to the desired flow rate downstream of the pump. If the flow rate input signal is greater than the setpoint, this corresponds to the flow rate downstream of the pump 39 being greater than the flow rate setpoint in the DPC 100. If the flow rate input signal is less than the setpoint, this corresponds to the flow rate downstream of the pump 39 being less than the flow rate setpoint in the DPC 100. If the flow rate input signal is equal the setpoint, this corresponds to the flow rate downstream of the pump 40 being equal the flow rate setpoint in the DPC 100.

The DPC 100 may be programmed to control the valve actuator 72 for the pinch valve assembly 50 on the basis of the flow rate input signal received from the fluid parameter sensing device 81. When the flow rate input signal is less than the flow rate setpoint, the DPC 100 sends an output signal to the valve actuator 72 which removes mechanical pressure from the sleeve 56, thereby opening the pinch valve 50 until the flow rate input signal matches the flow rate setpoint. This allows the wastewater to have a higher flow from the pump 39 through the sewage conduit 42 to the force main 43 and 24 with the desired backpressure. Too much backpressure and not enough flow will also cause discharge cavitation, which may prematurely age the pump.

When the flow rate input signal is greater than the flow rate setpoint, the DPC 100 sends a signal to the valve actuator 72 which increases mechanical pressure to the sleeve 56, thereby throttling the pinch valve sleeve 56. The pinch valve assembly 50 is throttled in an amount sufficient to match the flow rate setpoint of the DPC 100. The pinch valve 50 is throttled at a rate corresponding to the difference between the input signal and the setpoint according to the sensitivity setpoint of the DPC 100. As the pinch valve assembly 50 is throttled, it creates backpressure upstream of the pinch valve outlet 52 thereby reducing the flow downstream of the pump 39. As this backpressure increases, the flow rate sensed at the fluid parameter sensing device 81 decreases. The throttling of the pinch valve 50 continues until the flow rate sensed at the fluid parameter sensing device 81 is equal to the DPC flow rate setpoint or at least not in excess of the difference between the flow rate setpoint and the deadband setpoint of the DPC 100. This allows the wastewater to have the desired flow from the pump 39 through the sewage conduit 42 and force mains 43 and 24 with the appropriate backpressure. This flow rate is preset on the DPC 100 to provide for the most efficient operating conditions for the pump 39, and is sufficient to ensure that there is proper flow through the pump 39, and that the pressure will not cause discharge cavitation, which may prematurely age the pump.

The DPC 100 also has a user programmable setpoint that allows the pinch valve 50 be self-cleaning should blockage occur. If a blockage occurs downstream of the pump outlet 76, the fluid parameter sensing device 81 will sense a great increase in backpressure or a flow stoppage and generate a signal proportional to the fluid parameter sensed. A setpoint is programmed in the DPC 100 (for example 12 milliamps) corresponding to a maximum allowable backpressure (or minimum flow) from the sensing device 81. If the pressure input signal is greater than this pressure setpoint, the DPC 100 sends a signal to the valve actuator 72 which opens the pinch valve 50 until the high pressure condition ceases. When the pinch valve opens, flow increases and clears the blockage downstream of the pump unit 40.

Thus, the present invention provides a method of controlling the flow of sewage from a pump station 20 to a force main 43 and 24 by controlling the backpressure in the system to achieve efficient and safe flow through the system. In particular, the present invention uses a sensing device 81 and a DPC 100 for comparing fluid parameters sensed downstream of the pumping apparatus 40 to a fluid parameter setpoint in order to control the throttling of a pinch valve 50, and thereby control the flow of wastewater by controlling the backpressure downstream of the pump 40. By setting appropriate setpoints in the DPC 100, the invention is not only able to control the backpressure in the system, and thereby control cavitation of the pump 39, but is also able to sense blockage in the system and clear it automatically. Furthermore, the invention allows the pump 39 to perform properly at peak flow and backpressure conditions by opening the pinch valve 50 to the fully open position to permit the pump unit 40 to perform at full output against maximum backpressure.

While preferred embodiments of the invention have been shown and described, various modifications and substitutions may be made thereto without departing from the spirit and scope of the invention. Accordingly, it is to be understood that the present invention has been described by way of illustration, and that the scope of the invention is intended to be limited only by the scope of the appended claims.

I claim:

1. A sewage pumping apparatus for delivering sewage from a wet well to a force main, comprising:

a pump having a pump inlet and a pump outlet;

said pump inlet being in fluid communication with said wet well;

said pump outlet being in fluid communication with a first end of a sewage conduit;

a pinch valve having a valve inlet and a valve outlet;

said valve inlet being in fluid communication with said a second end of said sewage conduit;

said valve outlet being in fluid communication with said force main;

said pinch valve further comprising valve actuation means responsive to a first, second or third input signal;

a fluid parameter sensing device in communication with said sewage conduit, for sensing a fluid parameter at said sewage conduit;

said fluid parameter sensing device further comprising a first signal generation means for generating a signal proportional to said fluid parameter sensed; and a digital process controller in communication with said first signal generation means and said valve actuation means;

said digital process controller further comprising comparator means for comparing said signal proportional to said fluid parameter sensed and a first fluid parameter setpoint;

said digital process controller further comprising a second signal generation means for generating a first or second input signal to control said valve actuation means in response to a comparison of said signal proportional to said fluid parameter sensed and said first fluid parameter setpoint.

2. The sewage pumping apparatus according to claim 1, wherein said comparator means further comprises means for comparing said signal proportional to said fluid parameter sensed and a second fluid parameter setpoint indicative of system blockage;

and wherein said second signal generation means further comprises means for generating a third input signal to control said valve actuation means in response to a comparison of said signal proportional to said fluid parameter sensed and said second fluid parameter setpoint indicative of system blockage.

3. The sewage pumping apparatus according to claim 2, wherein said fluid parameter sensing device comprises flow sensing means for sensing a flow rate in said sewage conduit;

and wherein said first signal generation means comprises means for generating a first signal proportional to a sensed flow rate in said sewage conduit; and wherein said first or second fluid parameter setpoint is a flow rate setpoint.

4. The sewage pumping apparatus according to claim 2, wherein said fluid parameter sensing device comprises pressure sensing means for sensing a pressure in said sewage conduit;

and wherein said first signal generation means comprises means for generating a first signal proportional to a sensed pressure in said sewage conduit;

and wherein said first or second fluid parameter setpoint is a pressure setpoint.

5. The sewage pumping apparatus according to claim 3, wherein said second signal generation means generates a first input signal to said valve actuation means to decrease mechanical pressure from a deformable sleeve within said pinch valve when said signal proportional to said flow rate in said sewage conduit is lower than said first flow rate setpoint;

and wherein said second signal generation means generates a second input signal to said valve actuation means to increase mechanical pressure to said deformable sleeve within said pinch valve when said signal proportional to said flow rate in said sewage conduit is greater than said first flow rate setpoint.

6. The sewage pumping apparatus according to claim 4, wherein said second signal generation means generates a second input signal to said valve actuation means to increase mechanical pressure to said deformable sleeve within said pinch valve when said signal proportional to said pressure in said sewage conduit is less than said first pressure setpoint; and wherein said second signal generation means generates a first input signal to said valve actuation means to decrease mechanical pressure to said deformable sleeve within said pinch valve when said signal proportional to said pressure in said sewage conduit is greater than said first pressure setpoint.

7. The sewage pumping apparatus according to claim 5, wherein said second signal generation means generates a third input signal to said valve actuation means to remove mechanical pressure from said deformable sleeve within said pinch valve when said signal proportional to said flow rate in said sewage conduit is less than said second flow rate setpoint indicative of system blockage.

8. The sewage pumping apparatus according to claim 6, wherein said second signal generation means generates a third input signal to said valve actuation means to remove mechanical pressure from said deformable sleeve within said pinch valve when said signal proportional to said pressure in said sewage conduit is greater than said second pressure setpoint indicative of system blockage.

9. The sewage pumping apparatus according to claim 2, wherein said first signal generation means or said second signal generation means generates electrical signals.

10. The sewage pumping apparatus according to claim 9, wherein said electrical signals are in the range of 4 to 20 milliamps.

11. The sewage pumping apparatus according to claim 2, wherein said valve actuation means for said pinch valve is selected from the group comprising mechanical, electrical, electromechanical, hydraulic and pneumatic.

* * * * *